US007274887B2

(12) United States Patent
Mo et al.

(10) Patent No.: US 7,274,887 B2
(45) Date of Patent: Sep. 25, 2007

(54) SYSTEM AND METHOD FOR SETUP OF TONER CONCENTRATION TARGET FOR A TONER CONCENTRATION SENSOR

(75) Inventors: Song-Feng Mo, Webster, NY (US); Wendy K. Apton, Webster, NY (US); Jennifer R. Wagner, Walworth, NY (US); Stephen F. Randall, West Henrietta, NY (US); Patricio G. Medina, Rochester, NY (US); Patrick J. Walker, Rochester, NY (US); Richard A. Aman, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 127 days.

(21) Appl. No.: 11/032,935

(22) Filed: Jan. 11, 2005

(65) Prior Publication Data

US 2006/0153581 A1 Jul. 13, 2006

(51) Int. Cl.
*G03G 15/00* (2006.01)
*G03G 15/10* (2006.01)

(52) U.S. Cl. ..... 399/49; 399/59; 399/60; 399/72

(58) Field of Classification Search ..... 399/49, 399/53, 58, 59, 60, 72–74

See application file for complete search history.

(56) References Cited

U.S. PATENT DOCUMENTS

| | | | | |
|---|---|---|---|---|
| 5,504,557 | A * | 4/1996 | Morita | 399/56 |
| 5,710,958 | A | 1/1998 | Raj | |
| 5,895,141 | A | 4/1999 | Budnik et al. | |
| 6,285,840 | B1 | 9/2001 | Budnik et al. | |
| 6,426,630 | B1 | 7/2002 | Werner, Jr. | |
| 6,580,882 | B2 | 6/2003 | Hirsch et al. | |
| 6,694,109 | B1 | 2/2004 | Donaldson et al. | |
| 6,741,816 | B2 | 5/2004 | Shim et al. | |
| 6,771,912 | B1 | 8/2004 | Mo et al. | |
| 6,792,220 | B2 | 9/2004 | Randall et al. | |

* cited by examiner

*Primary Examiner*—Walter Benson
*Assistant Examiner*—Timothy J Dole
(74) *Attorney, Agent, or Firm*—Fay Sharpe LLP

(57) ABSTRACT

A method by which the target of a toner concentration (TC) sensor can be set up based on the equivalent developability concept without using an expensive patch generator. First, use a black toner area coverage (BTAC) sensor to measure the relative reflectance (RR) of a 100% area coverage developed patch (ROS generated) at a series of development levels ($V_{em}$ or $V_{dev}$) to generate a pseudo development curve and estimate $V_{dO}$ in real-time ($V_{dO}$ is the $V_{dev}$ level that starts to develop toner onto the photoreceptor belt.) Then, add a nominal delta $V_{dev}$ to $V_{dO}$ to get the development level ($V_{dev}$) needed to generate 100% area coverage gray patch. Finally, using a BTAC sensor to measure the RR level of a 100% area coverage (AC) gray patch, move the target of the TC sensor, and converge the sensor's reading to the sensor's target continuously until the RR level of the gray patch hits the RR target (predefined) within the tolerance range. Thus, the target of the TC sensor is set for the xerographic system automatically.

20 Claims, 4 Drawing Sheets

SYSTEM AND METHOD FOR SETUP OF TONER CONCENTRATION TARGET FOR A TONER CONCENTRATION SENSOR

BACKGROUND

The present exemplary embodiment relates generally to electrophotographic printing. It finds particular application in conjunction with setting the target of a toner concentration sensor in an electrophotographic printing machine, and will be described with particular reference thereto. However, it is to be appreciated that the present exemplary embodiment is also amenable to other like applications.

In xerographic print engines, there is normally a toner concentration (TC) sensor located in the sump of the developer housing. Most low cost TC sensors only output only relative TC information, not absolute TC information. Also TC variability from the same sensor target is due to several factors, including sensor manufacturing variability, environmental changes, developer aging characteristics, and characteristics of sensor aging due to mechanical wear. In the past, to determine if the TC level is correct, xerographic systems used expensive calibrated LED bars called patch generators to produce continuous tone control patches to set up the TC. For these reasons, a method is required to set up the target for the sensor, so that TC in the development housing meets the xerographic system requirements.

Such a method, however, requires the use of a development curve model. In Xerographic marking engines, the relationship between solid developed mass and development voltage, also called a development curve, plays an important role in xerographic process controls, diagnostics, and system integration. It is not realistic and nearly impossible to generate a development curve in the field. It is very time consuming and needs special equipment to remove toner from the photoreceptor in a controlled fashion and measure it. In practical applications, a development curve can be obtained by using a transmission densitometer to get referred DMA (developed mass per unit area). Compared to a reflection densitometer, a transmission densitometer is much more expensive and its reliability is not as good. Also, a development curve is a nonlinear function, which presents a challenge to develop a robust algorithm to estimate the parameters of the development curve model in real time.

Thus, there is a need for a new method by which the target of a toner concentration (TC) sensor can be set up based on the equivalent developability concept without using an expensive patch generator. There is also a need for a new strategy and method to generate a model of the development curve in real time using a low cost reflection densitometer. Instead of modeling the development curve directly, a pseudo development curve model is needed, based on the relationship of toner area coverage (TAC) and the development voltage $V_{dev}$ due to the saturation of the reflection sensor at high DMA. This pseudo development curve model is very similar to the real development curve and is sufficient for most applications in xerographic process controls, diagnostics, and integration.

BRIEF DESCRIPTION

The exemplary embodiment incorporates a new method by which the target of a toner concentration (TC) sensor can be set up based on the equivalent developability concept without using an expensive patch generator. Although the shape of the development curve varies with environment, the developability is equivalent (about the same) at low $V_{dev}$ if TC is properly set to the nominal per environment. In accordance with an aspect of the present exemplary embodiment, this setup is as follows. First, use a black toner area coverage (BTAC) sensor to measure the relative reflectance (RR) of a 100% area coverage developed patch (ROS generated) at a series of development levels ($V_{em}$ or $V_{dev}$) to generate a pseudo development curve and estimate $V_{dO}$ in real-time ($V_{dO}$ is the $V_{dev}$ level that starts to develop toner onto the photoreceptor belt.) Then, add a nominal delta $V_{dev}$ to $V_{dO}$ to get the development level ($V_{dev}$) needed to generate 100% area coverage gray patch. Finally, using a BTAC sensor to measure the RR level of a 100% area coverage (AC) gray patch, move the target of the TC sensor, and converge the sensor's reading to the sensor's target continuously until the RR level of the gray patch hits the RR target (predefined) within the tolerance range. Thus, the target of the TC sensor is set for the xerographic system automatically.

Since a low cost relative reflection sensor is used in the print engine, developed mass per unit area (DMA) cannot be measured or inferred explicitly. Therefore, it is difficult to generate a development curve in real-time. However, a pseudo development curve model (relationship between tonal area coverage (TAC) vs. $V_{dev}$) works well in most applications which need to use development curve information, especially with the application in the setup of the TC sensor target.

In accordance with another aspect of the present exemplary embodiment, there is provided a toner concentration set-up method for a xerographic print engine having a photoreceptor and a toner concentration sensor. The method comprises: using a densitometer to measure the relative reflectance of a 100% area coverage gray patch at a series of development voltage levels; generating a pseudo development curve; estimating in real-time the development voltage level $V_{dO}$ that starts to develop toner onto the photoreceptor; adding a nominal delta development voltage $V_{dev}$ to $V_{dO}$ to get the development level needed to generate a 100% area coverage gray patch on the photoreceptor; using the densitometer to measure the relative reflectance level of a new 100% area coverage gray patch; moving the target of the toner concentration sensor; and converging the toner concentration sensor's reading to the sensor's target continuously until the relative reflectance level of the new gray patch hits a predefined relative reflectance target within a predefined tolerance range.

In accordance with yet another aspect of the present exemplary embodiment there is provided a system for setting a toner concentration sensor for a print engine having development voltage. The system comprises: a toner concentration sensor; an electrostatic voltmeter; an imager that images a plurality of 100% area coverage gray patches on a photoreceptor; a developing device that develops the 100% area coverage gray patches; a sensor that senses the relative reflectance reflectivity of the 100% area gray patches; and software means operative on the print engine to: compute tonal area coverage at a series of development voltage levels; estimate a set of parameters to get a pseudo development curve model; set the development voltage level for the xerographic print engine; and read a pre-determined relative reflectance target and its tolerance for the toner concentration set-up from memory in the printing machine.

DETAILED DESCRIPTION

Figure 1:
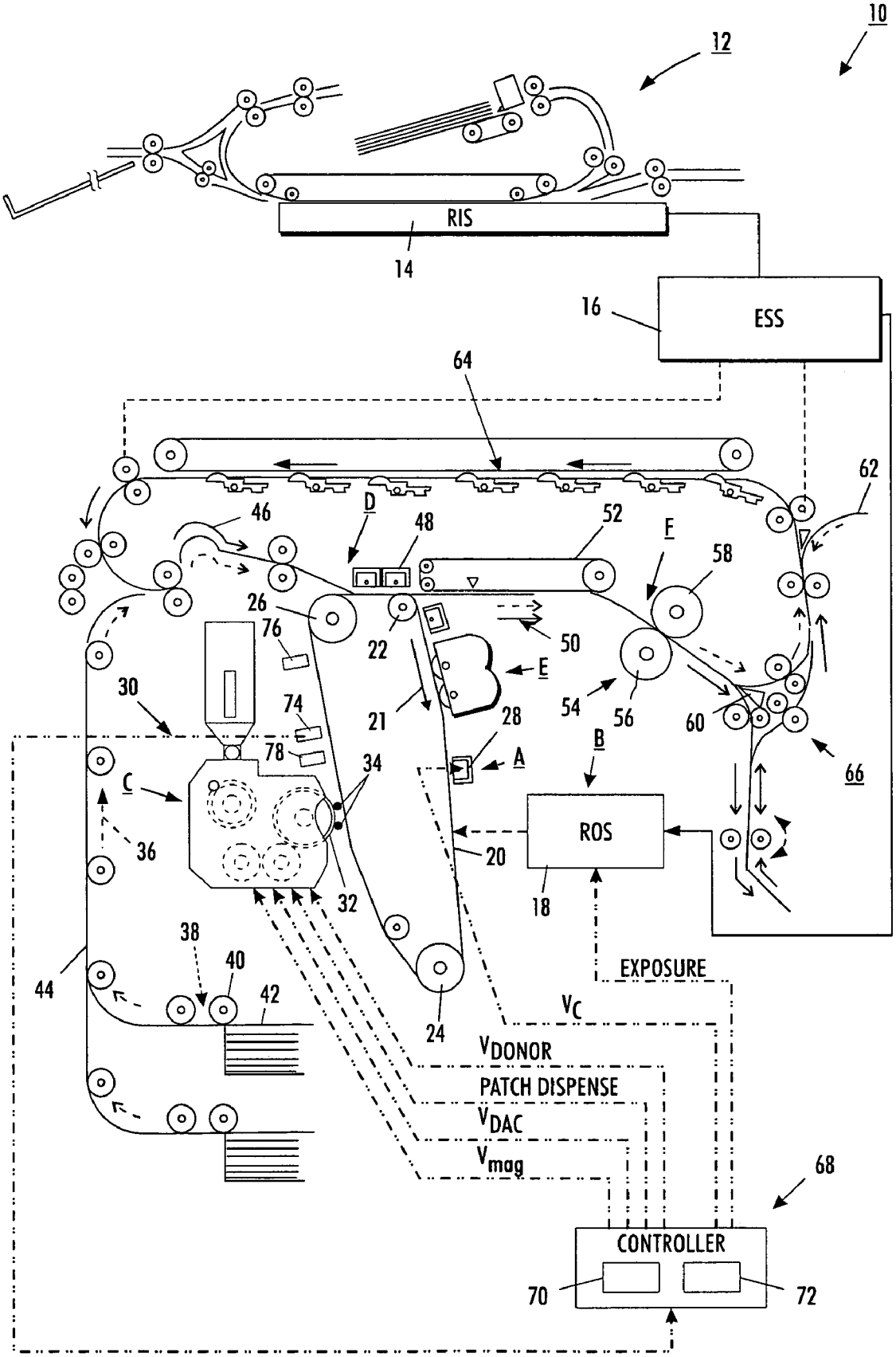
FIG. 1 is a schematic, elevational view showing an electrophotographic printing machine incorporating aspects of the present exemplary embodiment.

For a general understanding of the features of the present exemplary embodiment, reference is made to the drawings, wherein like reference numerals have been used throughout to designate identical elements. FIG. 1 schematically depicts the various elements of an illustrative electrophotographic printing machine 10 incorporating the method of the present exemplary embodiment therein. It will become evident from the following discussion that this method is equally well suited for use in a wide variety of printing machines and is not necessarily limited in its application to the particular embodiment depicted herein. Inasmuch as the art of electrophotographic printing is well known, the various processing stations employed in the printing machine 10 will be shown hereinafter and their operation described briefly with reference thereto.

Referring to FIG. 1, an original document is positioned in a document handler 12 on a raster input scanner (RIS) 14. The RIS 14 contains document illumination lamps, optics, a mechanical scanning drive, and a charge-coupled device (CCD) array. The RIS 14 captures the entire original document and converts it to a series of raster scan lines. This information is transmitted to an electronic subsystem (ESS) 16, which controls a raster output scanner (ROS) 18 described below.

Generally, a photoconductive belt (or photoreceptor) 20 is made from a photoconductive material coated on a ground layer, which, in turn, is coated on an anti-curl backing layer. The belt 20 moves in the direction of arrow 21 to advance successive portions sequentially through the various processing stations disposed about the path movement thereof. The belt 20 is entrained about a stripping roller 22, a tensioning roller 24, and a drive roller 26. As the drive roller 26 rotates, it advances the belt 20 in the direction of arrow 21.

Initially, a portion of the photoconductive surface passes through charging station A, where a corona generating device 28 charges the photoconductive surface of the belt 20 to a relatively high, substantially uniform potential.

At exposure station B, the controller or electronic subsystem (ESS) 16 receives the image signals representing the desired output image and processes these signals to convert them to a continuous tone or gray-scale rendition of the image which is transmitted to a modulated output generator, for example the ROS 18. Preferably, the ESS 16 is a self-contained, dedicated minicomputer. The image signals transmitted to the ESS 16 may originate from the RIS 14 as described above or from a computer, thereby enabling the electrophotographic printing machine 10 to serve as a remotely located printer for one or more computers. Alternatively, the printer may serve as a dedicated printer for a high-speed computer. The signals from the ESS 16, corresponding to the continuous tone image desired to be reproduced by the printing machine, are transmitted to the ROS 18. The ROS 18 includes a laser with rotating polygon mirror blocks. The ROS 18 will expose the photoconductive belt to record an electrostatic image thereon corresponding to the continuous tone image received from the ESS 16. As an alternative, the ROS 18 may employ a linear array of light emitting diodes (LEDs) arranged to illuminate the charged portion of the photoconductive belt 20 on a raster-by-raster basis.

After the electrostatic latent image has been recorded on the photoconductive surface of the belt 20, the belt 20 advances the latent image to a development station C where, a development system 30 develops the latent image. Preferably, the development system 30 includes a donor roll 32, a magnetic transfer roll, and electrode wires 34 positioned in a gap between the donor roll 32 and the photoconductive belt 20. The magnetic transfer roll delivers toner to a loading zone (not shown) located between the transfer roll and the donor roll 32. The transfer roll is electrically biased relative to the donor roll 32 to affect the deposited mass per unit area (DMA) of toner particles from the transport roll to the donor roll 32. One skilled in the art will realize that both the donor roll and magnetic transfer roll have A.C. and D.C. voltages superimposed thereon. The electrode wires 34 are electrically biased relative to the donor roll 32 to detach toner therefrom and form a toner powder cloud in the gap between the donor roll 32 and the photoconductive belt 20. The latent image attracts toner particles from the toner powder cloud forming a toner powder image thereon.

With continued reference to FIG. 1, after the electrostatic latent image is developed, the toner image present on the belt 20 advances to transfer station D. A print sheet 36 is advanced to the transfer station D by a sheet feeding apparatus 38. Preferably, the sheet feeding apparatus 38 includes a feed roll 40 contacting the upper most sheet from stack 42. The feed roll 40 rotates to advance the uppermost sheet from the stack 42 into a vertical transport 44. The vertical transport 44 directs the advancing sheet 36 of support material into a registration transport 46 past image transfer station D to receive an image from the belt 20 in a timed sequence so that the toner powder image formed thereon contacts the advancing sheet at transfer station D. Transfer station D includes a corona generating device 48, which sprays ions onto the back side of the sheet 36. This attracts the toner powder image from the photoconductive surface of the belt 20 to the sheet 36. After transfer, the sheet 36 continues to move in the direction of arrow 50 by way of a belt transport 52, which advances the sheet 36 to fusing station F.

Fusing station F includes a fuser assembly 54, which permanently affixes the transferred toner powder image to the copy sheet 36. Preferably, the fuser assembly 54 includes a heated fuser roller 56 and a pressure roller 58, with the powder image, on the copy sheet 36, contacting the fuser roller 56.

The sheet 36 then passes through the fuser 54, where the image is permanently fixed or fused to the sheet 36. After the sheet 36 passes through the fuser 54, a gate 60 either allows the sheet 36 to move directly via an output 62 to a finisher or stacker, or deflects the sheet into the duplex path 64, specifically, into a single sheet inverter 66. That is, if the sheet 36 is either a simplex sheet, or a completed duplex sheet having both side one and side two images formed thereon, the sheet 36 will be conveyed via the gate 60 directly to the output 62. However, if the sheet 36 is being duplexed and is then only printed with a side one image, the gate 60 will be positioned to deflect that sheet 36 into the inverter 66 and into the duplex loop path 64, where that sheet 36 will be inverted and then fed for recirculation back through transfer station D and the fuser 54 for receiving and permanently fixing the side two image to the backside of that duplex sheet, before it exits via path 62.

After the copy sheet is separated from the photoconductive surface of the belt 20, the residual toner/developer and paper fiber particles adhering to the photoconductive surface are removed at cleaning station E. Cleaning station E includes a rotatably mounted fibrous brush in contact with the photoconductive surface of the belt 20 to disturb and remove paper fibers and a cleaning blade to remove the non-transferred toner particles. The blade may be configured in either a wiper or doctor position depending on the application. Subsequent to cleaning, a discharge lamp (not shown) floods the photoconductive surface of the belt 20 to dissipate any residual electrostatic charge remaining thereon prior to the charging thereof for the next successive imaging cycle.

The various machine functions are regulated by the ESS 16. The ESS 16 is preferably a programmable microprocessor, which controls all the machine functions described above. The ESS 16 provides a comparison count of the copy sheets, the number of documents being recirculated, the number of copy sheets selected by an operator, time delays, jam corrections, and etc. The control of all the exemplary systems described above may be accomplished by conventional control switch inputs from the printing machine console, as selected by the operator. Conventional sheet path sensors or switches may be utilized to keep track of the position of the original documents and the copy sheets.

In electrophotographic printing, toner material changes in the development system 30 and changes in the photo induced discharge characteristics (PIDC) in the photoconductive belt 20 influence the process. Aging and environmental conditions (i.e., temperature and humidity) cause these changes. For example, after 200,000 copies, the PIDC of the photoconductive belt 20 is substantially different than it was when new. The tribo-electric charge on the toner material decays when the machine remains in non-print making condition. An idle period of 2-4 days reduces the charge by 8-10 tribo units. Thus, the machine has a set-up mode to adjust image quality output under different environmental conditions and age before real-time printing begins. The set-up mode does not pass paper through the machine. Instead it sets a plurality of nominal actuator values and sequentially performs one or more adjustment loops to obtain convergence on acceptable image quality parameters.

In FIG. 1, there is provided an adaptive controller 68 that adjusts image quality during the set-up mode. The adaptive controller 68 has a plurality of outputs comprising state variables used as actuators to control a tone reproduction curve (TRC). The real-time operation of the controller 68 is described in U.S. Pat. No. 5,436,705, which is incorporated by reference herein. The adaptive controller 68 may include a linear quadratic controller 70 and a parameter identifier 72 that divides the controller into the tasks of parameter identification and control modification. The state variable outputs of controller 68 include $V_C$, EXPOSURE, PATCH DISPENSE, $V_{DONOR}$, $V_{mag}$ and $V_{DAC}$. These outputs function as control actuators. After set-up, these control actuators are continuously updated as required to maintain the TRC.

$V_C$ controls a power supply output (not shown) for the corona generating device 28. EXPOSURE controls the exposure intensity delivered by the ROS 18. PATCH DISPENSE controls the amount of dispensed toner required to compensate for toner test patch variations. $V_{DONOR}$ and $V_{DAC}$ control DC and AC power supply voltages (not shown) applied to the donor roll 32, respectively. $V_{mag}$ controls a DC power supply voltage (not shown) applied to the magnetic transfer roll in developer system. Control algorithms for the linear quadratic controller 70 and the parameter identifier 72 process information and adjust the state variables to achieve acceptable image quality during the set-up mode of machine operation.

In various exemplary embodiments, the changes in output generated by the controller 68 are measured by a black toner area coverage (BTAC) sensor 74. The BTAC sensor 74 is located after development station C. It is an infrared reflectance type densitometer that measures the density of toner particles developed on the photoconductive the surface of belt 20. The manner of operation of the BTAC sensor 74 is described in U.S. Pat. No. 4,553,033, which is incorporated by reference herein.

It should be understood that the term black toner area coverage (BTAC) sensor or "densitometer" is intended to apply to any device for determining the density of print material on a surface, such as a visible-light densitometer, an infrared densitometer, an electrostatic voltmeter, or any other such device which makes a physical measurement from which the density of print material may be determined.

As shown FIG. 1, the electrophotographic printing machine 10 also preferably includes an electrostatic voltmeter (ESV) 76. The ESV 76 measures the voltage potential of control patches on the photoconductive surface 20 of the belt or drum. An example of a suitable ESV 76 is described in U.S. Pat. No. 6,426,630, which is incorporated by reference herein. A toner concentration (TC) sensor 78 senses the toner concentration in the developer structure.

In order to offer customers value-added diagnostic services using add-on hardware and software modules which provide service information on copier/printer products, a hierarchy of machine servers may be used in accordance with this exemplary embodiment. In the following, "machine" is used to refer to the device whose performance is being monitored, including, but not limited to, a copier or printer. "Server" is used to refer to the device(s) that perform the monitoring and analysis function and provide the communication interface between the "machine" and the service environment. Such a server may comprise a computer with ancillary components, as well as software and hardware parts to receive raw data from various sensors located within the machine at appropriate, frequent intervals, on a continuing basis and to interpret such data and report on the functional status of the subsystem and systems of the machine. In addition to the direct sensor data received from the machine, knowledge of the parameters in the process control algorithms is also passed in order to acknowledge the fact that process controls attempt to correct for machine parameter and materials drift and other image quality affecters.

Figure 2:
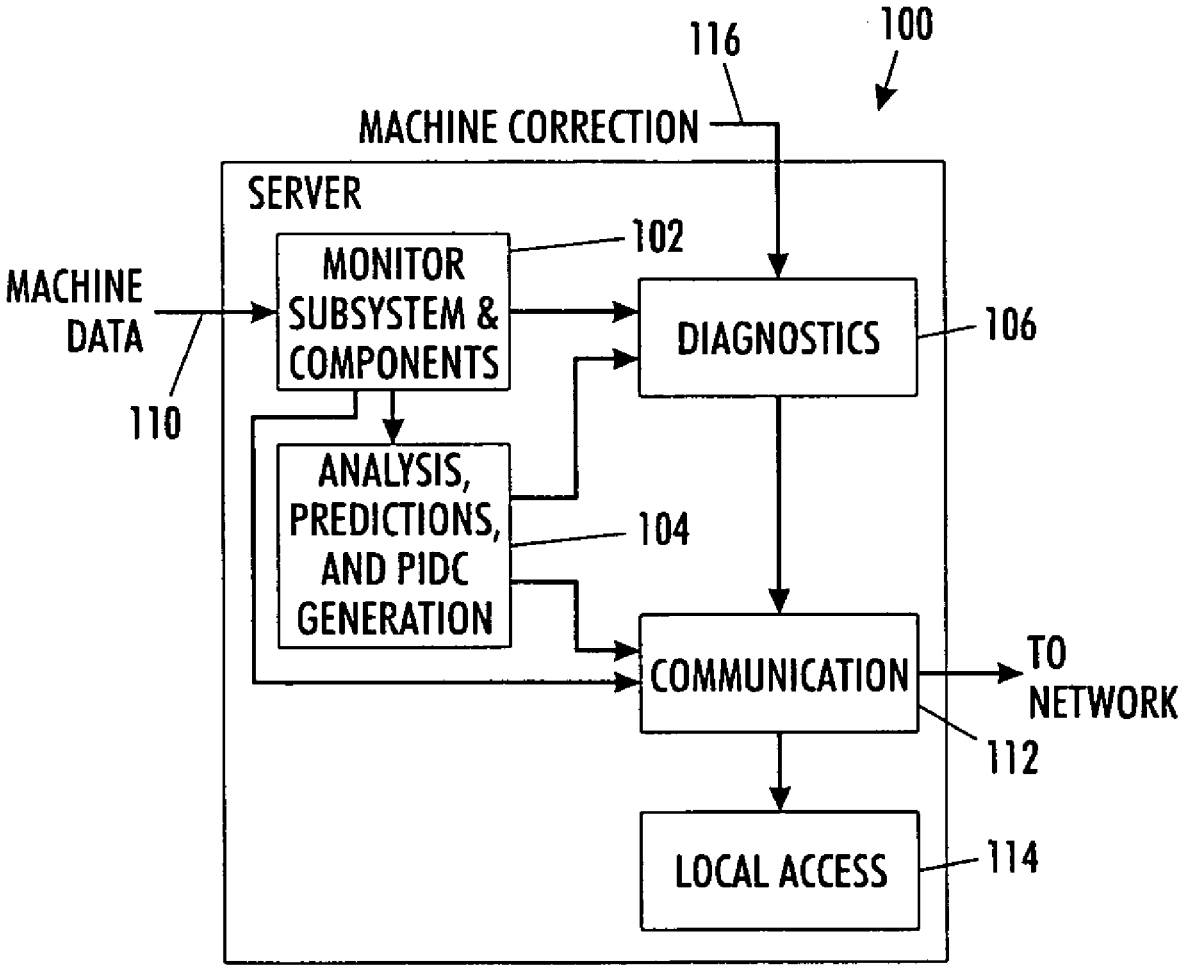
FIG. 2 is a schematic view of a machine server and interface in accordance with aspects of the present exemplary embodiment.

In the exemplary embodiment shown in FIG. 2, a server 100 includes a subsystem and component monitor 102, an analysis and predictions component 104, a diagnostic component 106 and a communication component 108. It should be understood that suitable memory may be included in the server 100, the monitor 102, the analysis and predictions component 104, the diagnostics component 106 and the communication component 108. The monitor 102 contains a preprocessing capability including a feature extractor which isolates the relevant portions of data to be forwarded on to the analysis and diagnostic elements. In general, the monitor 102 receives machine data, as illustrated at 110, and provides suitable data to the analysis and predictions component 104 to analyze machine operation and status and track machine trends such as usage of disposable components as well as usage data, and component and subsystem wear data. Diagnostic component 106 receives various machine sensor and control data from the monitor 102, as well as data from the analysis and predictions component 104 to provide immediate machine correction, as illustrated at 116, as well as to provide crucial diagnostic and service information through communication component 108, for example, via a line 112 to an interconnected network to a remote server on the network or to a centralized host machine with various diagnostic tools such as an expert system. Such information may include suitable alarm condition reports, requests to replenish depleted consumable, and data sufficient for a more thorough diagnostics of the machine. A local access 114 or interface for a local service representative may be provided to access various analysis, prediction, and diagnostic data stored in the server 100, as well as to interconnect any suitable diagnostic device.

Figure 3:
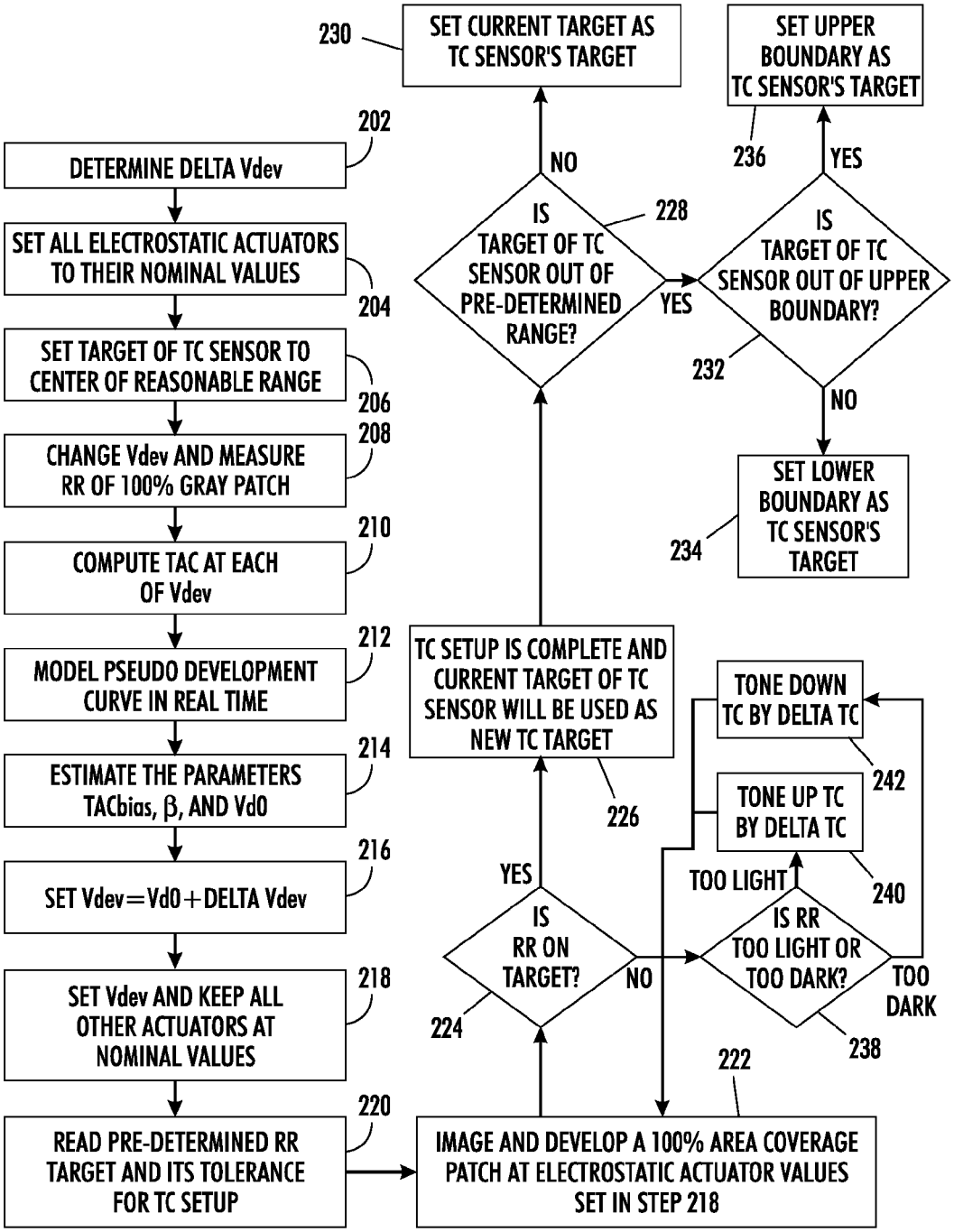
FIG. 3 is a flowchart outlining one exemplary method of setting up the toner concentration (TC) target for the TC sensor.

FIG. 3 provides a flowchart illustrating steps of a method for setting up the toner concentration (TC) target of the TC sensor 78 so that that TC is controlled within the desired ranges. The desired TC ranges are based on the current machine environment (temperature and relative humidity) and the tribological state of the material. Generally, lower TCs are desired in high humidity conditions and vice versa. This set-up method is described by the following steps:

In step 202, delta_$V_{dev}$ (where $V_{dev}$ is the development voltage) is determined. For the development system that is not sensitive to the gap between the development housing and photoreceptor belt, delta_$V_{dev}$ is a constant number and can be determined by experiments. For a development system that is sensitive to the gap between the donor roll of the development housing and the photoreceptor belt, such as hybrid jumping development (HJD), delta_$V_{dev}$ varies with the gap. Hybrid jumping development is described in, for example, U.S. Pat. No. 6,285,840, which is incorporated by reference herein.

Next, in step 204, all electrostatic (control) actuators are set to their nominal values. The electrostatic actuators include $V_C$, EXPOSURE, $V_{mag}$ and $V_{DAC}$. The nominal values are determined based on empirical testing and power supply limits and stored as non-vulnerable memory (NVM) in the machine 10.

In step 206, the target of the TC sensor 78 is set to the center of a reasonable range based on the environmental information (temperature and relative humidity), and the reading of the TC sensor 78 is converged to this target.

In step 208, $V_{dev}$ is changed by adjusting $V_{mag}$, and the BTAC sensor 74 is used to measure the relative reflectance of a ROS-generated 100% area coverage (AC) gray patch at each of a series development voltages.

In step 210, tonal area coverage (TAC) is computed at each of the development voltages in the series. In order to compute TAC, it is necessary to use a "pseudo development curve model."

In Xerographic marking engines, the relationship between solid developed mass per unit area (DMA) and development voltage ($V_{dev}$), also called a development curve, plays an important role in xerographic process controls, diagnostics, and system integration. A model of a pseudo development curve may be developed in real time using a low cost reflection densitometer. This model describes the relationship between toner area coverage (TAC) and $V_{dev}$, instead of the classic relationship between DMA and $V_{dev}$. The reason a pseudo development curve model is used is that reflection sensors, such as the BTAC sensor 74, saturates at high DMA, and the sensor signal is very noisy at low DMA. The theoretical limits for TAC are less than or equal to one and greater than or equal to zero. This pseudo development curve model is very similar to a development curve, and it is sufficient in most applications of xerographic process controls, diagnostics, and integration.

A standard development curve model is as follows:

$$DMA=0, \text{ when } V_{dev}<V_{d0\alpha}$$

Or $$DMA=\alpha(1-\exp^{((-\gamma/\alpha)*(Vdev-Vd0))}), \text{ when } V_{dev}>=V_{d0}$$

where:

DMA=developed mass per area coverage or referred DMA when a transmission densitometer is used;

$\alpha$=saturated developed mass level;

$\gamma$=decay slope of the development curve, and $\gamma=\gamma/\alpha$ is the nominal decay slope of the development curve; and $V_{d0}$=the voltage of $V_{dev}$ where mass development starts.

As mentioned above, there are some limitations of the reflection sensors for the development curve. Thus, TAC is defined as follows:

TAC=1−RR, where RR=the relative reflectance of a solid image developed from the sensor.

Figure 4:
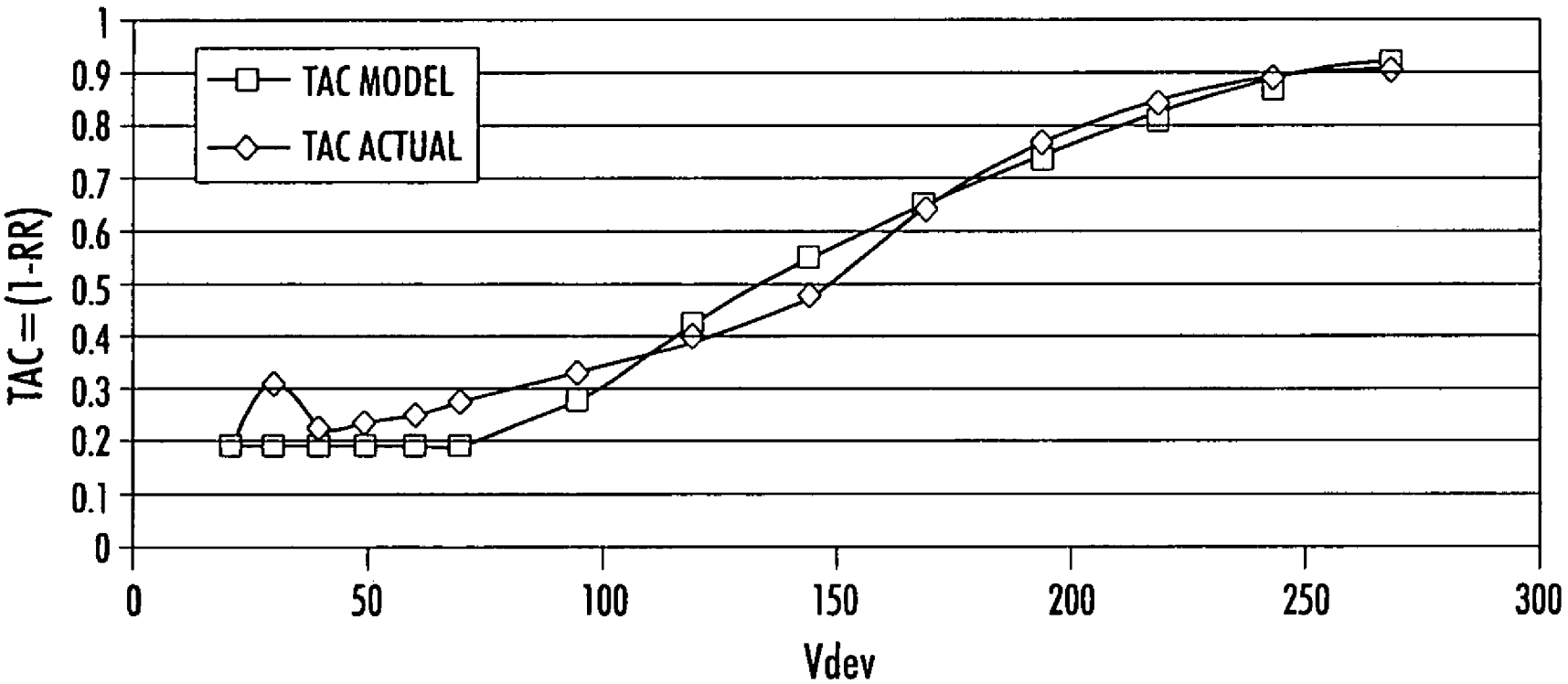
FIG. 4 is a graph showing the relationship between tonal area coverage (TAC) and development voltage $V_{dev}$.

The relationship between TAC and $V_{dev}$ is shown in FIG. 4, and it is referred to it as a pseudo development curve. As seen in FIG. 4, TAC will not reach zero at low $V_{dev}$ and the TAC will saturate at one (the range of the relative reflectance is from 0 to 1) as $V_{dev}$ increases, but the shape of the pseudo development curve is the same as the development curve. The pseudo development curve model as follows:

$$TAC=TAC_{bias}, \text{ when } V_{dev}<V_{d0},$$

or $$TAC=TAC_{bias}+(1-TAC_{bias})*(1-\exp^{(-\beta-(Vdev\ Vd0))}) \text{ when } V_{dev}>=V_{d0}$$

where:

$TAC_{bias}$=TAC saturation level at low $V_{dev}$;

$\beta$=nominal decay slope of the pseudo development curve; and $V_{d0}$=the voltage of $V_{dev}$ where mass development starts.

Thus, in step 212, the pseudo development curve is modeled in real time based on TAC and $V_{dev}$. After defining the pseudo development curve model and getting the TAC data from the sensor and calculating $V_{dev}$ based on $V_m$ and the estimated $V_e$, the next step is to develop an algorithm to estimate $TAC_{bias}$, $\beta$, and $V_{dO}$. Since the pseudo development curve model is a nonlinear model, a nonlinear parameter estimation algorithm has been developed to obtain the optimized parameters: $TAC_{bias}$, $\beta$, and $V_{d0}$ in real time. Test results indicate that parameter estimation of the pseudo development curve model will be completed within milliseconds and the completed process includes data acquisition and modeling that will be completed in less than 10 seconds. FIG. 4 shows both actual measured data and data prediction based on the model.

In step 214, the parameters of $TAC_{bias}$, $\beta$, and $V_{dO}$ are estimated to get the pseudo development curve model. The parameter optimization algorithm used to estimate $TAC_{bias}$ and $V_{dO}$ is disclosed in U.S. Pat. No. 6,771,912 (FIG. 9 and Equations 9 to 22).

In step 216, set $V_{dev}=V_{dO}$+delta_$V_{dev}$.

In step 218, set $V_{dev}$ and keep all other electrostatic actuators ($V_C$, EXPOSURE, $V_{mag}$ and $V_{DAC}$) at their nominal values. This is done so that the actuators will not affect the RR of the gray patch to be used in determining the TC level.

In step 220, the pre-determined RR target and its tolerance for the TC setup is read from the memory or disk.

In step 222, a new ROS-generated 100% area coverage gray patch is developed on the photoreceptor 10 at the electrostatic-actuator values set in step 218, as known in the art, and then a BTAC sensor 74 is used to measure the relative reflectance.

In step 224, determine whether the relative reflectance is on target within the tolerance range. If so, then TC setup is completed and the current target of the TC sensor 78 will be used as the new TC target (step 226). Next, determine whether the target of the TC sensor 78 is out of the pre-determined range (step 228). If it is not out of range, then set the current target as the TC sensor's target (step 230).

However, if the target is out of range, then determine whether the target of the TC sensor 78 is out of the upper boundary (step 232). If not, then set the lower boundary as the TC sensor's target (step 234). Otherwise, set the upper boundary as the TC sensor's target (step 236).

With reference to step 224, if the relative reflectance measurement indicates that the image (100% area coverage gray patch) is not on target within the tolerance range, then determine whether it is too light or too dark (step 238). If the relative reflectance measurement indicates that the image is too light, then tone up TC by delta TC (step 240). If the relative reflectance measurement indicates that the image is too dark, then tone down TC by delta TC (step 242).

The exemplary toner concentration (TC) target setup method disclosed above is performed via embedded software in the print engine 10. The present exemplary embodiment provides a method to setup the proper TC level in the xerographic system automatically without any human intervention and any extra parts, such as a patch generator, and will be completed within minutes. This exemplary embodiment requires a system that contains an electrostatic voltmeter (ESV) and an infrared densitometer, such as a BTAC sensor. Means for sensing temperature and relative humidity is preferred but is not necessary.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A toner concentration set-up method for a xerographic print engine having a photoreceptor and a toner concentration sensor with a target, the method comprising:

setting the target of the toner concentration sensor based on the current environment of the print engine, wherein the environment comprises temperature and relative humidity;

using a densitometer to measure the relative reflectance of a 100% area coverage gray patch at a series of development voltage levels;

generating a pseudo development curve model in real time;

estimating in real-time the development voltage level $V_{dO}$ that starts to develop toner onto the photoreceptor;

adding a nominal delta development voltage $V_{dev}$ to $V_{dO}$ to get the development level needed to generate a 100% area coverage gray patch on the photoreceptor;

using the densitometer to measure the relative reflectance level of a new 100% area coverage gray patch;

moving the target of the toner concentration sensor; and converging the toner concentration sensor's reading to the sensor's target continuously until the relative reflectance level of the new gray patch hits a predefined relative reflectance target within a predefined tolerance range.

2. The method defined in claim 1, wherein the densitometer is a black toner area coverage sensor.

3. The method defined in claim 1, further comprising sensing ambient temperature and relative humidity in the area of the xerographic print engine.

4. The system defined in claim 1, wherein the print engine comprises a non-contact development system where there is a gap between a donor roll and a photoreceptor belt or a contact development system where the gap is set to zero.

5. A method of setting a toner concentration target of a toner concentration sensor in a print engine having a development voltage, the method comprising:

determining delta development voltage level;

setting all electrostatic actuators for the printing machine to their nominal values;

setting the target of the toner concentration sensor to the center of a reasonable range based on the current environment of the print engine, wherein the environment comprises temperature and relative humidity;

imaging a 100% area coverage gray patch at a series of development voltage levels;

developing the series of 100% area coverage gray patches;

measuring the relative reflectance value of the 100% area coverage gray patch with a sensor;

computing the tonal area coverage at the series of development voltage levels;

estimating a set of parameters to get a pseudo development curve model in real time;

setting the development voltage level for the printing machine;

reading a pre-determined relative reflectance target and its tolerance for the toner concentration set-up from memory in the printing machine;

imaging a new 100% area coverage gray patch at the nominal electrostatic actuator values;

developing the new 100% area coverage gray patch; and measuring the relative reflectance of the new 100% area coverage gray patch with the sensor.

6. The method defined in claim 5, further comprising:

determining whether the target of the toner concentration sensor is out of the reasonable range.

7. The method defined in claim 6, further comprising:

where the target of the toner concentration sensor is within the reasonable range, setting a current target for the toner concentration sensor to a new boundary; and using this new boundary as a new target for the toner concentration sensor.

8. The method defined in claim 7, further comprising:

where the target of the toner concentration sensor is outside the reasonable range, determining whether the new gray patch is too light or too dark.

9. The method defined in claim 8, further comprising:

where the new gray patch is too light, toning up the toner concentration by delta toner concentration.

10. The method defined in claim 8, further comprising:

where the new gray patch is too dark, toning down the toner concentration by delta toner concentration.

11. The method defined in claim 5, wherein the electrostatic actuators include $V_c$, EXPOSURE, $V_{mag}$ and $V_{DAC}$.

12. The method defined in claim 5, wherein the print engine comprises a xerographic print engine.

13. The method defined in claim 5, wherein the sensor comprises a black toner area concentration sensor.

14. The method defined in claim 5, further comprising sensing ambient temperature and relative humidity in the area of the xerographic print engine.

15. The method defined in claim 5, wherein the print engine comprises a non-contact development system where there is a gap between a donor roll and a photoreceptor belt or a contact development system where the gap is set to zero.

16. A system for setting a toner concentration sensor for a print engine having at least one development voltage level, the system comprising:

a toner concentration sensor;

an electrostatic voltmeter;

an imager that images a plurality of 100% area coverage gray patches on a photoreceptor;

a developing device that develops the 100% area coverage gray patches;

a sensor that senses the relative reflectance reflectivity of the 100% area gray patches; and software means operative on the print engine to:

set a target of the toner concentration sensor based on the current environment of the print engine, wherein the environment comprises temperature and relative humidity;

compute tonal area coverage at a series of development voltage levels;

estimate a set of parameters to generate a pseudo development curve model in real time;

set the development voltage level for the print engine; and read a pre-determined relative reflectance target and its tolerance for the toner concentration set-up from memory in the print engine.

17. The system defined in claim 16, further comprising at least one ambient temperature sensor and at least one relative humidity sensor.

18. The system defined in claim 16, wherein the sensor comprises a black toner area concentration sensor.

19. The system defined in claim 16, wherein the print engine comprises a xerographic print engine.

20. The system defined in claim 16, wherein the print engine comprises a non-contact development system where there is a gap between a donor roll and a photoreceptor belt or a contact development system where the gap is set to zero.

* * * * *